US005344094A

United States Patent [19]

Hoffman

[11] Patent Number: 5,344,094

[45] Date of Patent: Sep. 6, 1994

[54] PROCESS AND APPARATUS FOR RETAINING AND DISPENSING A COILED ARTICLE

[76] Inventor: Julius E. Hoffman, 475 Cornmill Rd., Cowpens, S.C. 29330

[21] Appl. No.: 855,061

[22] Filed: Mar. 19, 1992

[51] Int. Cl.[5] ..... B65H 75/00

[52] U.S. Cl. ..... 242/395; 242/129.71; 242/396.5; 242/405.3; 242/407

[58] Field of Search ..... 242/106, 85, 129, 129.71, 242/129.72, 139, 75.4, 99, 156; 384/607, 609, 615

[56] References Cited

U.S. PATENT DOCUMENTS

| | | | |
|---|---|---|---|
| 1,640,760 | 4/1927 | Emery | 242/156 |
| 2,375,098 | 5/1945 | Geczy | 242/156 |
| 3,326,495 | 6/1967 | De Bruyn | 242/129 |
| 3,638,878 | 2/1972 | Morris | 242/139 X |
| 4,360,172 | 11/1982 | Cope | 242/106 X |
| 4,423,609 | 1/1984 | Itoh | 242/129.71 X |
| 4,634,077 | 1/1987 | Wilson | 242/139 |
| 4,667,897 | 5/1987 | Burrow | 242/129 |
| 4,699,530 | 10/1987 | Satoh | 384/609 |
| 4,948,272 | 8/1990 | Stone | 384/607 |
| 4,953,810 | 9/1990 | Stadig | 242/85 X |
| 5,097,565 | 3/1992 | Shorey | 364/607 X |

*Primary Examiner*—Daniel P. Stodola
*Assistant Examiner*—Eileen A. Dunn
*Attorney, Agent, or Firm*—Hardaway Law Firm

[57] ABSTRACT

A novel apparatus for retaining and dispensing a coiled article is provided comprising a disc-shaped base having a platform rotatably mounted thereto and barring therebetween, a support structure for supporting a coiled article fixedly and co-axially attached to the platform a post held by and extended co-axially from the support structure and upper plate mounted co-axially and adjustably on the post for slidable movement toward and away from the support structure, and a mechanism for locking the upper plate into position along the post.

2 Claims, 2 Drawing Sheets

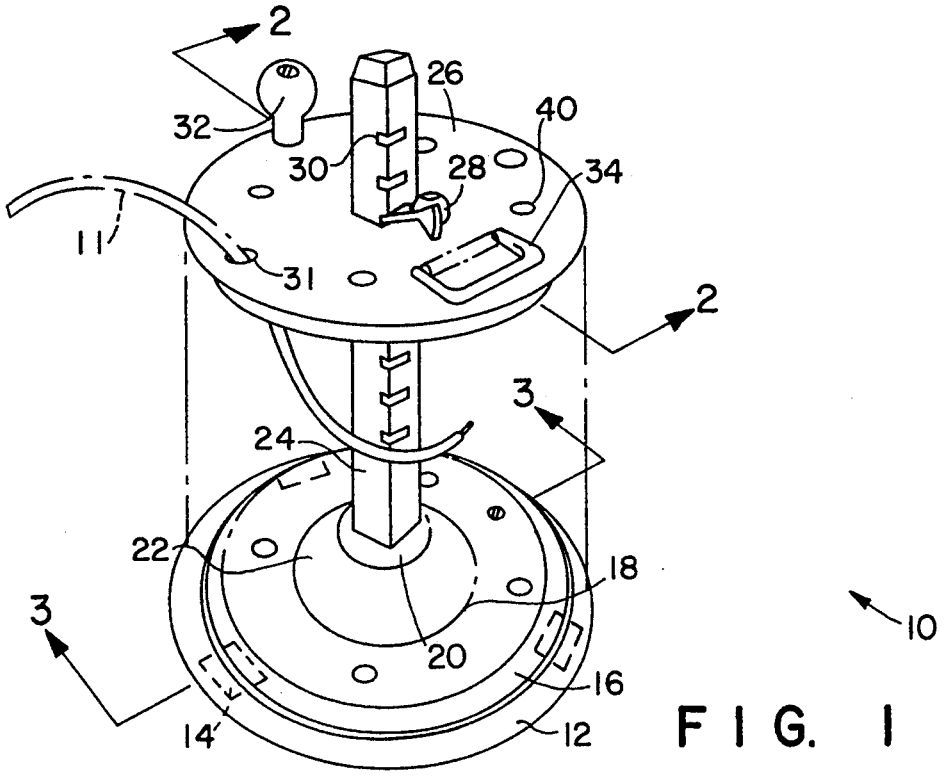
FIG. 1
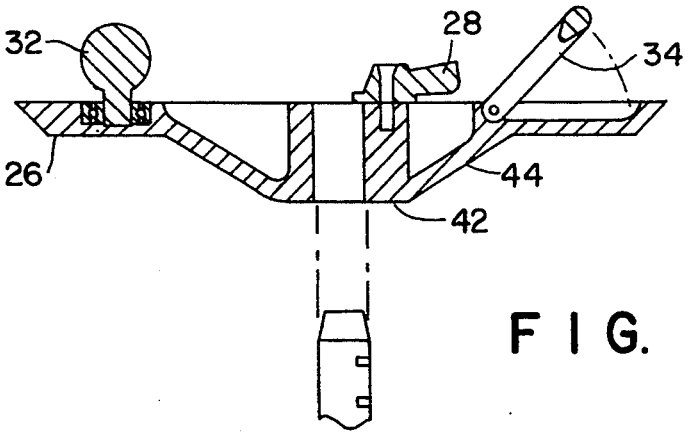
FIG. 2
FIG. 3
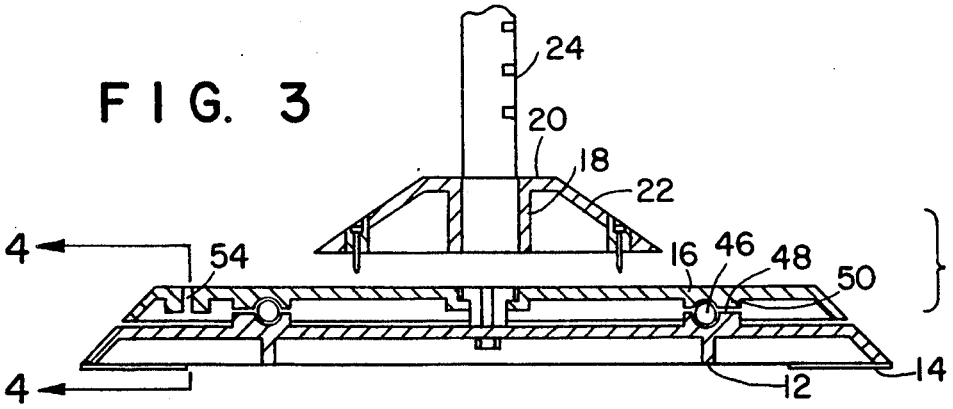

PROCESS AND APPARATUS FOR RETAINING AND DISPENSING A COILED ARTICLE

BACKGROUND OF THE INVENTION

This invention relates generally to retaining and dispensing devices, and more particularly to a process and apparatus for retaining and dispensing a coiled article.

It has been very common in the past to provide certain articles in coils for ease of handling. When such articles consist of flexible material, the article so coiled is usually easy to handle. It is also common that such coiled articles consist of less flexible materials and difficulties arise in handling the coiled article when it is a somewhat inflexible material. The handling of electrical wire particularly, which is often coiled, can be difficult as for retaining and dispensing due to its stiff nature.

There are various devices within the prior art directed to retaining a coiled article. Such devices range from horizontal pegs mounted to platforms over which a coiled article can be placed to reel type retainers which are also useful in dispensing a coiled article retained thereon.

U.S. Pat. No. 4,967,978 discloses various embodiments of a wire storage reel generally comprising resilient side members forming a reel hub with the side members cooperating with each other to form an annular wire storage cavity circumscribing the hub, the first cavity opening to a second annular wire storage cavity, whereby the resilient side members can be pressed inwardly to selectively close the outer end of the second cavity.

U.S. Pat. No. 2,905,408 discloses an adjustable and disassembleable reel upon which strand material such as cable can be wound. Once wound, the reel is disassembleable to thereby permit withdrawal of the cable thereon. The reel comprises a drum formed of a plurality of spaced longitudinal grooves and a plurality of circumferential slots extending from each of the grooves, a fixed flange secured to the drum and a detachable flange having an aperture therein to permit it to be placed on the drum and to be movable therealong.

Another adjustable reel assembly is disclosed in U.S. Pat. No. 4,428,546, where an adjustable spool is taught comprising a pair of engageable, substantially identical, hermaphroditic components, each component including an end flange axially spaced from the other by an adjustable drum portion. A plurality of axially extending splines project from each flange toward the other and define the drum portion. The splines are spaced circumferentially about the axis and are arranged to interfit circumferentially in assembly. Each flange defines openings for receipt therein of free ends of the splines.

U.S. Pat. No. 3,212,729 discloses a wire dispensing apparatus comprising a split wire receiving spool formed from two substantially identical halves, a split casing for the reel having a small opening in the periphery thereof for passage of a single strand of wire therethrough, a bearing member for providing rotational movement of the spool relative to the casing, and a threaded axle on which the spool can rotate and for holding the parts together.

Another apparatus for holding a coiled article such as wire is disclosed in U.S Pat. No. 3,326,495 which teaches a reel comprising a base with a shaft thereon, two spaced parallel face plates mounted for rotation on the shaft and slidable thereon, a series of fingers parallel to the shaft and extending between the face plates to define a core co-axial with the shaft and around which the coil is adapted to be located. The diameter of the core is allowed to be changed by one end of each finger being hinged to one of the face plates, and a series of inclined flanges on the shaft protrude through one of the face plates and abut against each of the fingers so that the face plate moves towards the inclined flanges. The fingers ride up the flanges and are forced outwardly to increase the diameter of the core.

U.S. Pat. No. 4,913,369 discloses a reel for storing an elongated insertion tube for a bore scope in a protected, yet readily available condition for easy coiling and uncoiling. The reel comprises a reel compartment for the coiled tube and an inner foam-filled storage compartment for the proximal end of the tube and the associated control modules therefore, the entire reel being arranged for rotation about its axis and having a cover to secure and protect the apparatus stored therein.

Yet another holder and dispenser for a coiled article is disclosed in U.S. Pat. No. 4,953,810 wherein a coiled article holder especially adapted for assisting in dispensing of the article from the coil as needed is disclosed. The holder comprises a turntable which has a post extending co-axially therefrom and a plate mounted over the post for slidable movement thereon. An article guide which also acts as a turntable brake is provided on the plate and includes an aperture through which the coiled article is pulled during dispensing. There is no provision, however, for locking the slidable plate into a position on the post, and accordingly, the slidable post is permitted to rest upon the coiled article. This lack of a provision to secure the slidable plate into a position along the post permits the slidable plate to lift up, causing the coiled article to frequently wrap around the post out of alignment with the rest of the coiled article. Also, in rewinding a coiled article through the brake mechanism, the slidable plate frequently rises up, again causing a portion of the coiled article to wrap around the post out of alignment with the rest of the coiled article.

In view of the prior art, there exists significant room for improvement to overcome various disadvantages in the art of apparatuses for retaining and dispensing a coiled article.

SUMMARY OF THE INVENTION

It is thus an object of this invention to provide a novel apparatus for retaining and dispensing a coiled article.

It is another object of the invention to provide an apparatus for retaining and dispensing a coiled article which can retain and dispense various different types of coiled articles.

It is still another object of this invention to provide an apparatus for retaining and dispensing a coiled article which can be adjustably set to accommodate coils of a variety of different sizes.

It is a further object of this invention to provide an apparatus for retaining and dispensing a coiled article wherein the coiled article can be easily dispensed in any direction from the apparatus.

It is a still further object of this invention to provide an apparatus for retaining and dispensing a coiled article which assists in centering a coiled article thereon.

It is a yet further object of this invention to provide an apparatus for retaining and dispensing a coiled article which includes braking means for braking the apparatus when retaining or dispensing is stopped.

These as well as other objects are accomplished by an apparatus for retaining and dispensing a coiled article comprising a disc-shaped base having a platform rotatably mounted thereto and bearings therebetween, a support structure for supporting a coiled article fixedly and co-axially attached to the platform, a post held by and extending co-axially from the support structure, an upper plate mounted co-axially and adjustably on the post for slidable movement toward and away from the support structure, and means for locking the upper plate into position along the post.

BRIEF DESCRIPTION OF THE DRAWINGS

FIG. 2 is a cross section view along line 2—2 of FIG. 1 illustrating an upper plate according to the present invention.

FIG. 3 is a cross section view along line 3—3 of FIG. 1.

DETAILED DESCRIPTION

In accordance with this invention it has been found that a novel apparatus for retaining and dispensing a coiled article can be provided. It has also been found that such an apparatus can be provided which can retain and dispense various different types of coiled articles. It has further been found that such an apparatus can be provided which can be adjustably set to accommodate coils of a variety of different sizes. Such an apparatus also can be provided which permits a coiled article to easily be dispensed in any direction from the apparatus. The apparatus further can assist in centering a coiled article thereon and includes braking means for braking the apparatus when retaining or dispensing is stopped. Further advantages and features will become apparent from the following description given with reference to the various figures of drawings.

Figure 1A:
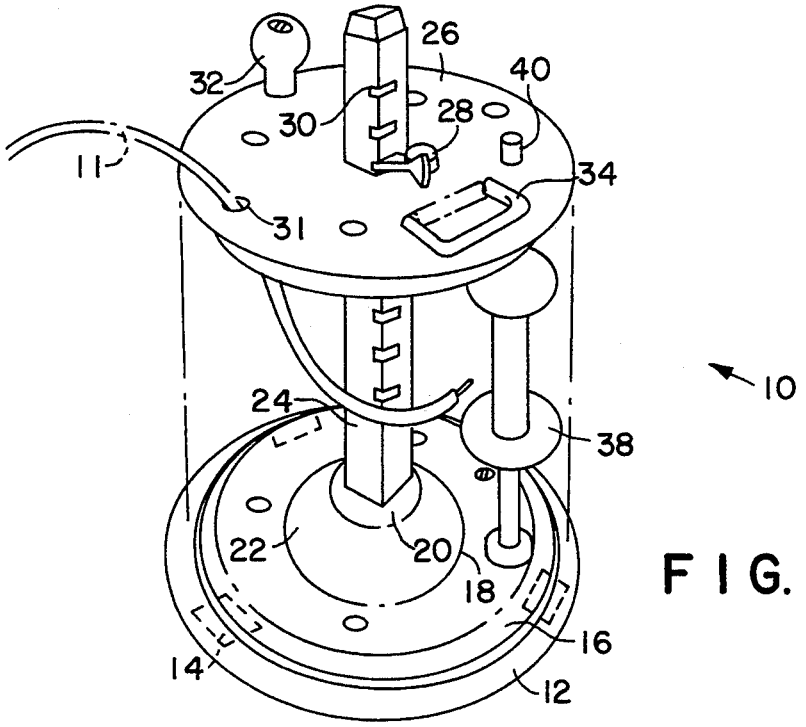
FIG. 1 is a perspective view of an apparatus for retaining and dispensing a coiled article according to the present invention.

FIG. 1 of the drawings is a perspective view of an apparatus 10 for retaining and dispensing an article 11 to be coiled. A disc-shaped base 12 is included in apparatus 10 and may include a plurality of friction pads 14, illustrated in phantom, for providing stability to apparatus 10.

Rotatably mounted to base 12 is a platform 16 which is also disc-shaped in the preferred embodiment. A support structure 18 for supporting a coiled article is fixedly and co-axially attached to platform 16. In a preferred embodiment, support structure 18 defines a flat raised center portion 20 co-axial with platform 16 and base 12 to help retain and dispense a coiled article. Support structure 18 further includes a tapered outer peripheral surface 22 which extends upwardly and inwardly from support structure 18 to form the flat raised portion 20. A post 24 is held by and extends co-axially from support structure 18. In the preferred embodiment, post 24 extends from flat raised center portion 20 defined by support structure 18.

Apparatus 10 further comprises an upper plate 26 mounted co-axially and adjustably on post 24 for slidably movement toward and away from support structure 18. It is preferred that upper plate 26 also be disc-shaped.

As a distinctive feature of the present invention, apparatus 10 includes means for locking upper plate 26 into position along post 24 which in a preferred embodiment is illustrated as a latch 28 mounted to upper plate 26 adapted to be received in one of a plurality of spaced notches 30 defined by post 24. Post 24 is illustrated as being square in configuration. As illustrated, upper plate 26 can be slidably moved along post 24 and locked into position on post 24 by latch 28 being shifted into position into one of a plurality of notches 30 defined by post 24.

As an advantageous feature of this invention, apparatus 10 enables a coiled article to easily be dispensed in generally any direction from apparatus 10. Because of the open configuration of apparatus 10 allowed by platform 16 and upper plate 26, a coiled article retained thereon can easily be pulled or dispensed from apparatus 10 in any direction 360° around apparatus 10. A coiled article can even be pulled off apparatus 10 to a higher position at even a forty-five degree (45°) angle, which is especially desirable when installing electrical wiring.

To help retain an article coiled on apparatus 10, a hole 31 is defined by upper plate 26. The end of an article coiled on apparatus 10 can be inserted up through hole 31 and bent back towards upper plate 26. This feature of the present invention is especially useful when using electrical wire which is generally rigid.

As further illustrated in FIG. 1, apparatus 10 further includes a knob handle 32 mounted on upper plate 26 in a preferred embodiment to provide aide in retaining an article 11 to be coiled thereon. Upper plate 26 can include a flip-up handle 34 which enables apparatus 10 to be easily carried against a persons body even with a coiled article thereon.

In its preferred embodiment, base 12, platform 16 and upper plate 26 have outer edges which are slanted inwardly towards the center of apparatus 10 where a coiled article is retained. This subtle feature is very important and helps keep a coiled article centered on apparatus 10. Especially useful during dispensing, this feature keeps even a portion of a coiled article that may be loosely retained on apparatus 10 from causing problems.

In one embodiment of the present invention, apparatus 10 includes additional means for retaining a coiled article which is illustrated in FIG. 1 as an axle 36 having a spool 38 thereon. Axle 36 with spool 38 thereon is held in place by and positioned between platform 16 and upper plate 26 by apertures 40 which are adapted to receive axle 36. Axle 36 with spool 38 thereon extends parallel to post 24, and it is preferred that axle 36 and spool 38 be positioned between platforms 16 and upper plate 26 at their outer peripheries. It is envisioned that a plurality of axles with spools thereon can be fitted into apparatus 10 simultaneously. This allows a plurality of spools of the same or different coiled articles to be simultaneously dispensed from apparatus 10.

FIG. 2 of the drawings is a cross section view along line 2—2 of FIG. 1 illustrating upper plate 26 of apparatus 10. Upper plate 26 is illustrated in FIG. 2 in the preferred embodiment in which upper plate 26 has a centrally located portion with a tapered outer peripheral surface 44 which extends inwardly toward said post and downwardly toward support structure 18 to form a flat lower center portion 42 for helping retain and dispense a coiled article. Its flat lower center portion 42 defined by upper plate 26 which is adapted to receive post 24 to enable upper plate 26 to be slidably moveable thereon toward or away from support structure 18. Peripheral surface 44 of upper plate 26 extending to form lower center portion 42 in the preferred embodiment is essentially a mirror-image of peripheral surface 22 which tapers to form raised center portion 20 in support structure 18. By these configurations, upper plate 26 and support structure 18 act to assist in centering a coiled article as it is retained on apparatus 10.

Also illustrated in FIG. 2 is knob handle 32, flip-up handle 34 and latch 28 as discussed with reference to FIG. 1.

FIG. 3 of the drawings is a cross section view along line 3—3 of FIG. 1. Illustrated in FIG. 3 is base 12 having friction pads 14 mounted on the bottom thereof. Platform 16 is rotatably mounted to base 12, with bearings 46 rotatably positioned between platform 16 and base 12 to enable platform 16 to be rotationally movable on base 12. In a preferred embodiment, bearings 46 are rotatably mounted in a channel 48 defined by and between base 12 and platform 16, and a blocking means illustrated as a flange 50 for keeping foreign matter out of channel 48 and therefore away from bearings 46 is positioned in channel 48. This advantageous feature of the present invention is a great aide in helping prevent foreign matter from contacting bearings 46 and thereby slowing the rotational movement of platform 16 on base 12. Support structure 18 is illustrated in FIG. 3 in its preferred embodiment as defining peripheral surface 22 which extends in a tapered manner to form raised center flat portion 20 from which post 24 extends. Post 24 is held in co-axial position against platform 16 by support structure 18 which is fixedly secured to platform 16 as illustrated in FIG. 3.

Figure 4:
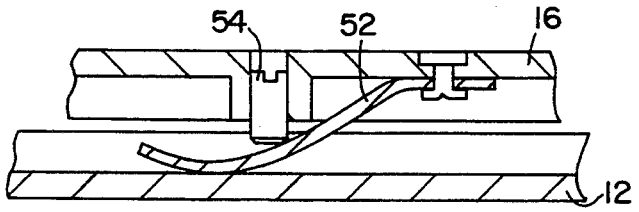
FIG. 4 is a cross section view along line 4—4 of FIG. 3 illustrating a preferred embodiment of braking means according to the present invention.

FIG. 4 of the drawings is a cross section view along line 4—4 of FIG. 3 illustrating a preferred embodiment of braking means according to the present invention. This braking means is provided as an advantageous feature of the present invention to help assure that platform 16 comes to a quick rotational halt on base 12 when it is desired that retaining or dispensing be stopped. In the preferred embodiment, the braking means comprises a brake member 52 which is fixedly attached to platform 16 and extends to rub against base 12. A brake screw 54 is illustrated as positioned within platform 16 and extending against brake member 52. Brake screw 54 can be adjusted to press against brake member 52 thereby causing brake member 52 to be forced against base 12 slowing the rotational movement of platform 16 on base 12. Brake screw 54 is also illustrated in FIG. 3 of the drawings. Such braking means is important to apparatus 10 in order to prevent excessive winding and possible entanglement of a coiled article when it is desired that retaining or dispensing be stopped.

Figure 5:
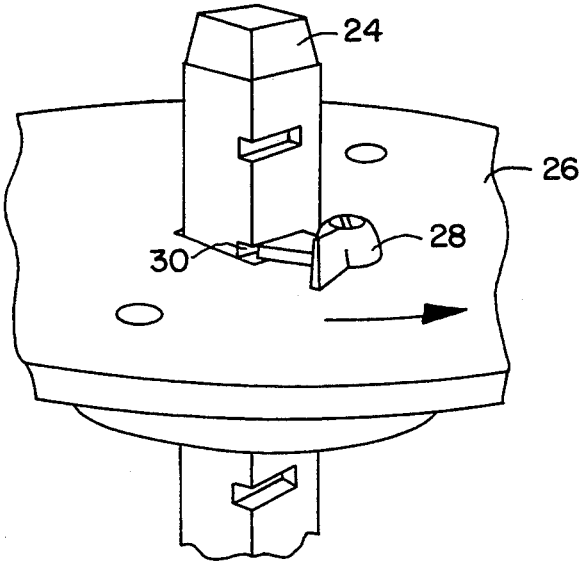
FIG. 5 is a fragmentary perspective view of an upper plate locked into position along a post according to the present invention.

FIG. 5 of the drawings is a fragmentary perspective view of upper plate 26 locked into position along post 24 according to the present invention. As illustrated and discussed with reference to FIG. 1 above, post 24 defines a plurality of notches 30 and a latch 28 is mounted to upper plate 26 in the preferred embodiment. FIG. 5 illustrates latch 28 received within one of plurality of notches 30 whereby latch 28 can be shifted away from notch 30 to free upper plate 26 for slidable movement on post 24.

When used for retaining an already coiled article for subsequent dispensing, referring to FIG. 1, upper plate 26 of apparatus 10 is removed from post 24 and a coiled article is then placed around post 24. Upper plate 26 can then be placed back into position on post 24 and latch 28 can be used to lock upper plate 26 into a predetermined position along post 24. With base 12 being positioned on a floor or other flat surface, dispensing of the coiled article can begin.

When apparatus 10 is used to retain an article 11 to be coiled, upper plate 26 can be locked into a predetermined position along post 24 and knob handle 32 can then be used to wind article 11 around peripheral surfaces 22 and 44. Once wound, hole 31 can be used to "tie off" a coiled article. Coiled articles of a variety of different types and sizes can therefore be retained on and dispensed from apparatus 10, including such coiled articles as welding cable and T.W. wire.

To provide ease of transportation of apparatus 10, flip-up handle 34 can be used to carry apparatus 10 wherein even with a coiled article thereon, flip-up handle 34 can be used to carry apparatus 10 with the bottom of base 12 positioned against the side of a person carrying apparatus 10. In this manner, carrying apparatus 10 causes minimal strain to a persons back. Also, the location of flip-up handle 34 on upper plate 26 enables flip-up handle 34 to be somewhat concealed when not in use and allows upper plate 26 to be removed from post 24 without having to worry about the location or position of flip-up handle 34.

It is thus seen that the present invention provides a novel apparatus for retaining and dispensing a coiled article. It is also seen that the present invention provides an apparatus for retaining and dispensing a coiled article which can retain and dispense various types of coiled articles. It is also seen that the present invention provides an apparatus for retaining and dispensing a coiled article which can be adjustably set to accommodate coils of a variety of different sizes. It is further seen that the present invention provides such an apparatus which allows a coiled articles to be dispensed in any direction from the apparatus. It is still further seen that such an apparatus is provided which can assist in centering a coiled article retained thereon. It is yet still further seen that the present invention provides such an apparatus which includes braking means for braking the apparatus when retaining or dispensing is stopped. Many variations are apparent to those of skill in the art, and such variations are embodied within the spirit and scope of the present invention as measured by the following appending claims.

That which is claimed:

1. An apparatus for retaining and dispensing a coiled article comprising:

a disc-shaped base having a platform rotatably mounted thereto and bearings therebetween;

a support structure for supporting the coiled article fixedly and co-axially attached to said platform said support structure having a tapered outer peripheral surface extending upwardly and inwardly to form a flat raised center portion;

a post extending co-axially from said platform, said post having a bottom positioned against said platform and said post held in position against said platform by said support structure;

an upper plate mounted co-axially and adjustably on said post for slidable movement toward and away from said support structure, said upper plate having a centrally located portion with a tapered outer peripheral surface, which extends inwardly toward said post and downwardly toward said support structure to form a flat lower center portion;

means for locking said upper plate into position along said post; and additional means for retaining an additional coiled article, said additional means positioned between said platform and said upper plate generally parallel to said post.

2. An apparatus for retaining and dispensing a coiled article comprising:

a disc-shaped base having a platform rotatably mounted thereto and bearings therebetween;

a support structure for supporting the coiled article fixedly and co-axially attached to said platform said support structure having a tapered outer peripheral surface extending upwardly and inwardly to form a flat raised center portion;

a post extending co-axially from said platform, said post having a bottom positioned against said platform and said post held in position against said platform by said support structure;

an upper plate mounted co-axially and adjustably on said post for slidable movement toward and away from said support structure, said upper plate having a centrally located portion with a tapered outer peripheral surface which extends inwardly toward said post and downwardly toward said support structure to form a flat lower center portion;

means for locking said upper plate into position along said post; and additional means for retaining an additional coiled article, said additional means comprising an axle having a spool thereon, said axle and said spool positioned between said platform and said upper plate generally parallel to said post.

* * * * *